US009808817B2

(12) United States Patent
Luczak et al.

(10) Patent No.: US 9,808,817 B2
(45) Date of Patent: Nov. 7, 2017

(54) PAINT SPRAYER FLOATING PUMP

(71) Applicant: Graco Minnesota Inc., Minneapolis, MN (US)

(72) Inventors: Mariusz J. Luczak, Elk River, MN (US); Harold D. Johnson, Zimmerman, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 222 days.

(21) Appl. No.: 14/701,784

(22) Filed: May 1, 2015

(65) Prior Publication Data

US 2015/0314312 A1 Nov. 5, 2015

Related U.S. Application Data

(60) Provisional application No. 61/987,659, filed on May 2, 2014.

(51) Int. Cl.

| | |
|---|---|
| ***B05B 9/04*** | (2006.01) |
| ***B05B 9/08*** | (2006.01) |
| ***B05B 11/00*** | (2006.01) |

(52) U.S. Cl.

CPC ..... *B05B 9/0861* (2013.01); *B05B 9/0426* (2013.01); *B05B 9/0855* (2013.01); *B05B 11/3001* (2013.01); *B05B 11/3015* (2013.01); *B05B 11/3043* (2013.01)

(58) Field of Classification Search

CPC ... B05B 9/0413; B05B 9/0426; B05B 9/0855; B05B 9/0861; B05B 11/3001; B05B 11/3015; B05B 11/3043; B05B 11/3045

See application file for complete search history.

(56) References Cited

U.S. PATENT DOCUMENTS

| | | | | |
|---|---|---|---|---|
| 2,618,224 | A | 11/1952 | Haugdahl | |
| 3,472,170 | A | 10/1969 | Eckerle | |
| 3,674,382 | A | 7/1972 | Kubota et al. | |
| 3,993,250 | A | 11/1976 | Shure | |
| 4,108,582 | A | 8/1978 | Bitton | |
| 4,340,338 | A | 7/1982 | Lemke | |
| 4,401,167 | A * | 8/1983 | Sekizawa | B25D 17/043 173/162.1 |
| 5,052,500 | A * | 10/1991 | Ohtsu | B24B 23/005 16/431 |

(Continued)

FOREIGN PATENT DOCUMENTS

KR 100632143 B1 9/2006

OTHER PUBLICATIONS

International Search Report and Written Opinion from PCT Application Serial No. PCT/US2015/028729, dated Jul. 27, 2015, 12 pages.

*Primary Examiner* — Ryan Reis
(74) *Attorney, Agent, or Firm* — Kinney & Lange, P.A.

(57) ABSTRACT

A fluid sprayer includes a pump motor, a piston, a pump housing, and an outer housing. The piston is reciprocatable by the pump motor. The pump housing comprises a pump chamber housing disposed to receive the piston, and a plurality of alignment pins extending laterally away from the pump chamber housing. The outer housing surround and anchors the pump motor, and has a plurality of internal lateral bores disposed to slideably receive and retain the alignment pins, such that the pump housing is free to self-align with the piston.

19 Claims, 3 Drawing Sheets

(56) References Cited

U.S. PATENT DOCUMENTS

| | | | | |
|---|---|---|---|---|
| 5,447,376 | A | 9/1995 | Cunningham | |
| 6,626,380 | B1 * | 9/2003 | Williams | B05B 9/0861 222/333 |
| 7,182,280 | B2 * | 2/2007 | Ye | B05B 9/0861 222/333 |
| 8,596,555 | B2 | 12/2013 | Thompson et al. | |
| 2003/0052194 | A1 | 3/2003 | Streutker et al. | |
| 2007/0278787 | A1 * | 12/2007 | Jones | B05B 9/01 285/45 |
| 2009/0084872 | A1 | 4/2009 | Vanblaere et al. | |
| 2009/0152304 | A1 | 6/2009 | Foster | |
| 2009/0175750 | A1 | 7/2009 | Ascari et al. | |
| 2010/0044468 | A1 | 2/2010 | Granger et al. | |
| 2011/0174900 | A1 * | 7/2011 | Munn | B05B 15/065 239/303 |
| 2011/0240766 | A1 * | 10/2011 | Peterson | B05B 9/0861 239/332 |
| 2012/0037726 | A1 * | 2/2012 | Johnson | B05B 9/0861 239/333 |
| 2014/0034754 | A1 | 2/2014 | Thompson et al. | |

* cited by examiner

PAINT SPRAYER FLOATING PUMP

CROSS-REFERENCE TO RELATED APPLICATION(S)

This application claims the benefit of U.S. Provisional Application No. 61/987,659 filed May 2, 2014 for "Paint Sprayer Floating Pump" by Mariusz J. Luczak and Harold D. Johnson.

BACKGROUND

The present invention relates generally to fluid sprayers, and more particularly to paint sprayer pumps.

High pressure fluid sprayers commonly use piston or plunger pumps to pressurize spray fluid. Some such systems use wobble plates to convert rotational motion of a motor into axial reciprocation of a plunger or piston. Wobble plates introduce side (lateral) loads in addition to primary axial loads. If pistons are misaligned with pump housings, these side loads can result in dramatic heating that can melt or otherwise damage pump components. To minimize misalignment, most spray systems have tight tolerances for pump and housing parts.

SUMMARY

The present invention is directed toward a fluid sprayer that includes a pump motor, a piston, a pump housing, and an outer housing. The piston is reciprocatable by the pump motor. The pump housing comprises a pump chamber housing disposed to receive the piston, and a plurality of alignment pins extending laterally away from the pump chamber housing. The outer housing surround and anchors the pump motor, and has a plurality of internal lateral bores disposed to slideably receive and retain the alignment pins, such that the pump housing is free to self-align with the piston.

The present summary is provided only by way of example, and not limitation. Other aspects of the present disclosure will be appreciated in view of the entirety of the present disclosure, including the entire text, claims, and accompanying figures.

Figure 1:
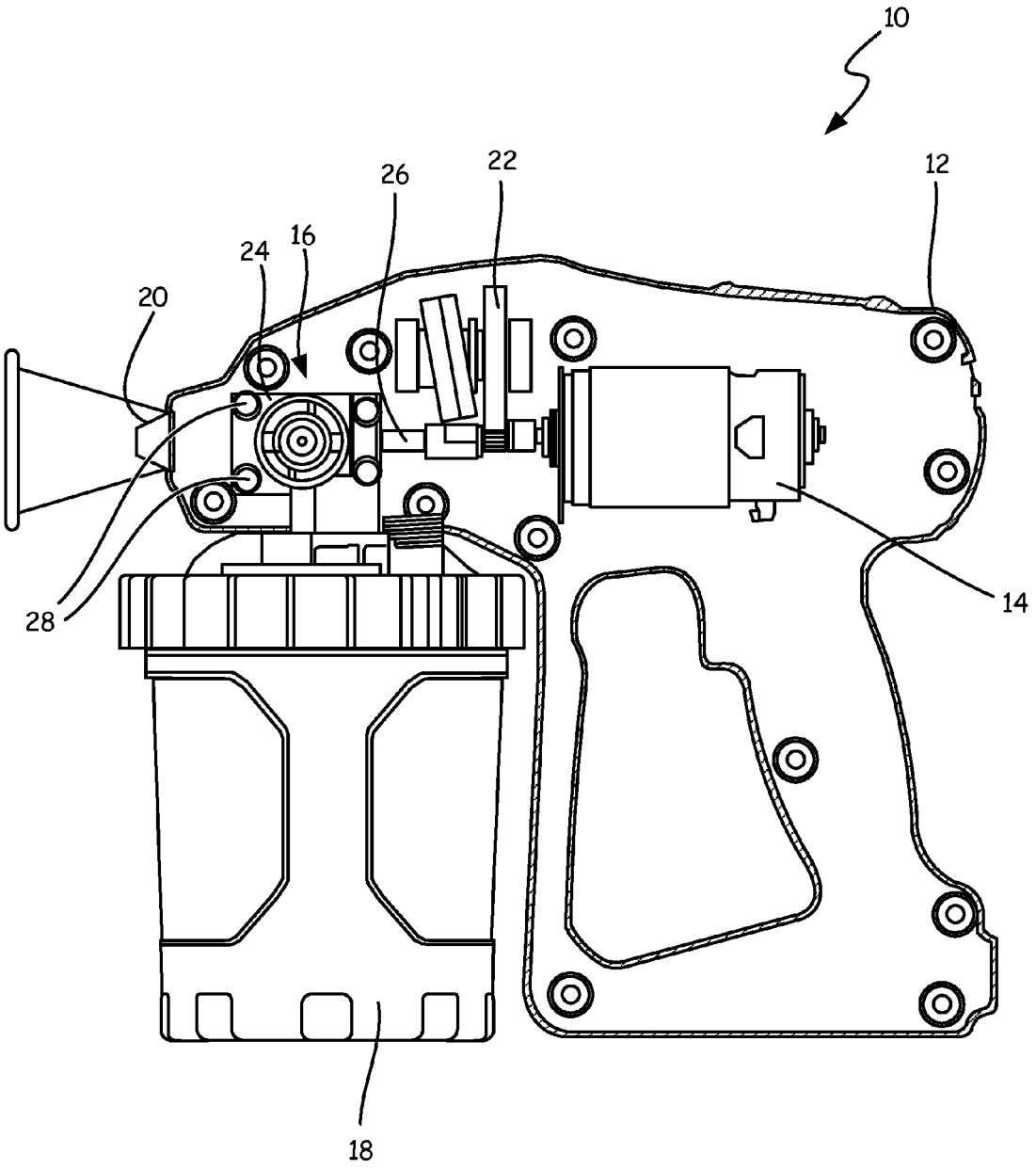
FIG. 1 is a partial axial cross-sectional view of a fluid sprayer.

While the above-identified figures set forth one or more embodiments of the present disclosure, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings.

DETAILED DESCRIPTION

The present invention is directed towards a pump housing secured via pins that fit slideably within bores of a clamshell outer housing. Unlike conventional rigid structures with tight tolerances, this assembly allows the pump housing to shift laterally within the bores, enabling the pump housing to passively self-align with the piston. This self-alignment reduces side loads without the need for tight alignment tolerances.

FIG. 1 is a partial axial cross-sectional view of fluid sprayer 10, which comprises outer housing 12, motor 14, pump assembly 16 (including pump housing 24, piston 26, and alignment pins 28), fluid source 18, nozzle 20, and drive mechanism 22. In the depicted embodiment, fluid sprayer 10 is a handheld sprayer for fluids such as paint or varnish. In alternative embodiments, sprayer 10 can be a sprayer for a fixed industrial installation or automatic device.

Outer housing 12 of sprayer 10 is a substantially rigid structural body that contains and supports most elements of spray system 10. Outer housing 12 can, for example, be formed of plastic clamshell sections as described in greater detail with respect to FIGS. 2 and 3. Outer housing 12 encloses and retains motor 14, a rotary motor. In one embodiment, motor 14 can be an electric motor powered by an electric cable or battery (not shown). Motor 14 drives pump assembly 16, thereby drawing spray fluid from fluid source 18 and expelling this fluid through nozzle 20. Nozzle 20 can, for example, be a spray nozzle with a narrow, atomizing outlet aperture.

Pump assembly 16 is a pumping structure that includes pump housing 24 and piston 26. In one embodiment pump assembly 16 is a high-pressure capable pump rated for pressures of up to 2000 psi. Pump housing 24 surrounds piston 26, which reciprocates within pump housing 24 to draw spray fluid from fluid source 18, and expel spray fluid through nozzle 20. Piston 26 can, for example, be a reciprocating shaft of a piston pump or diaphragm pump. In the depicted embodiment, fluid source 18 is an on-board reservoir of spray fluid. In alternative embodiments, fluid source 18 can, for example, be a fluid line connected to a nearby storage tank. As depicted in FIG. 1, drive mechanism 22 is a wobble (or swash) plate assembly. More generally, however, drive mechanism 22 can be any sort of mechanical transformer that converts rotational force from motor 14 into axial movement of drive shaft 26. Nozzle 20, pump housing 24, and piston 26 are all aligned along spray axis A.

Figure 3:
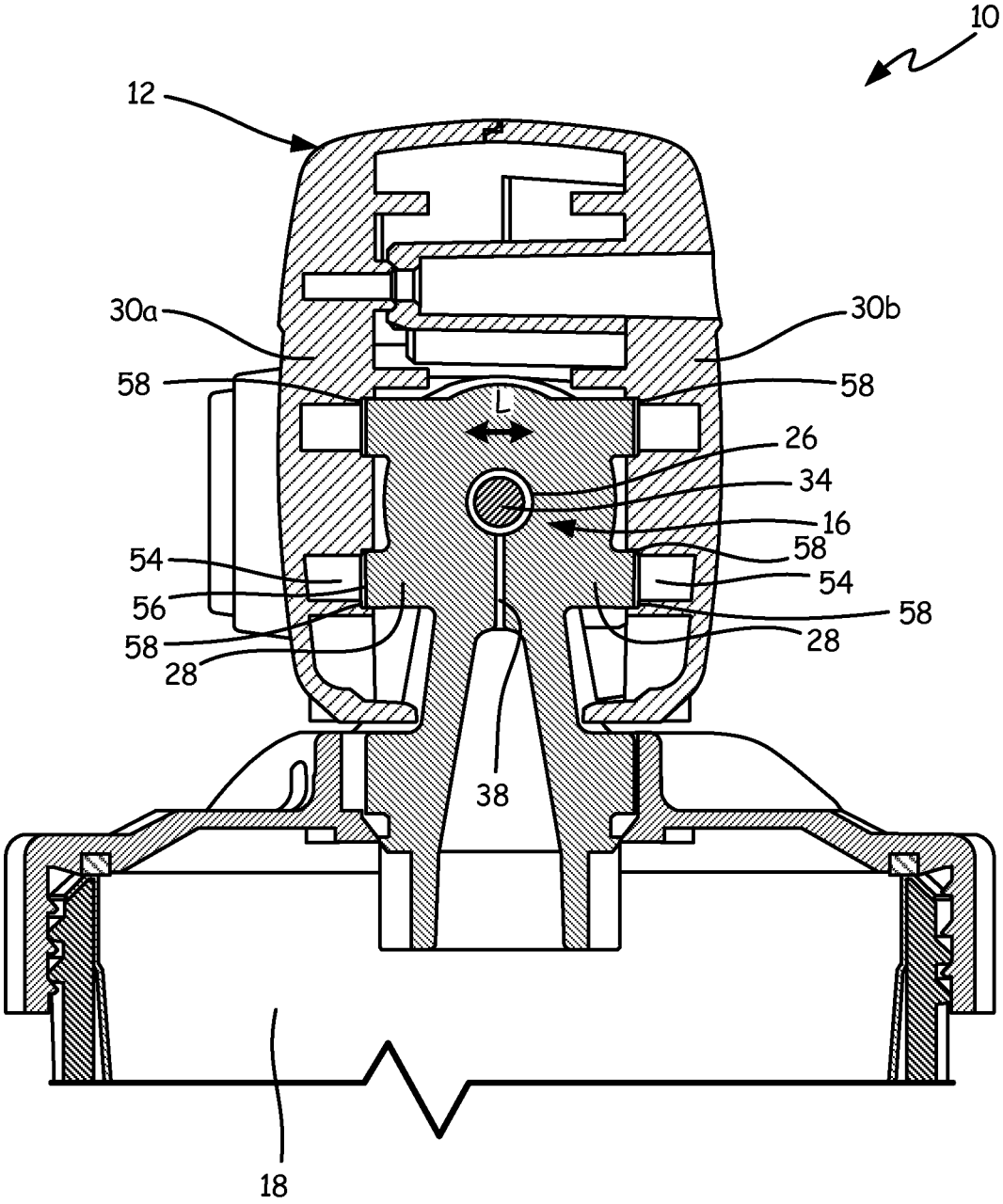
FIG. 3 is a lateral cross-sectional view of a portion of the fluid sprayer of FIG. 1.

Pump housing 24 includes a plurality of alignment pins 28 that are described in greater detail with respect to FIG. 3. Alignment pins 28 are retention pins that extend laterally (i.e. perpendicularly to spray axis A) from pump housing 24. In the depicted embodiment, four of eight alignment pins 28 are visible, while another four such alignment pins 28 are situated on an opposite side of pump housing 24. Alignment pins 28 are all parallel, and in the depicted embodiment are arranged in a rectangular pattern. Alignment pins 28 slideably mate with corresponding bores in outer housing 12, thereby locking pump housing 24 against axial movement (i.e. along spray axis A) while allowing pump 24 a degree of lateral freedom to move relative to drive mechanism 22. This lateral freedom permits pump housing 24 to self-align with piston 26, alleviating side (i.e. lateral) loads.

Figure 2:
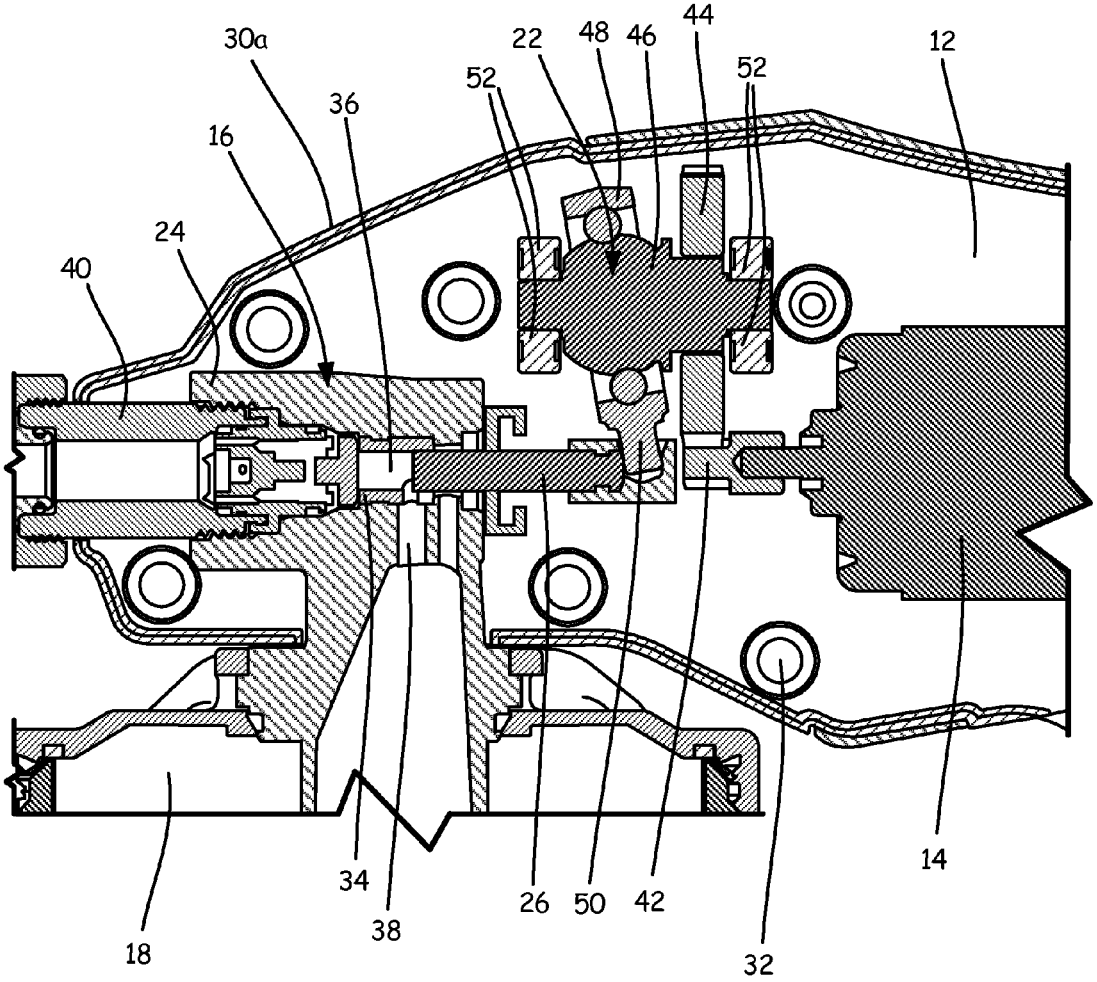
FIG. 2 is an axial cross-sectional view of a portion of the fluid sprayer of FIG. 1.

FIG. 2 is a close-up axial cross-sectional view of a portion of fluid sprayer 10. FIG. 2 illustrates outer housing 12, motor 14, pump assembly 16 (including pump housing 24, piston 26, pump chamber housing 34, pumping chamber 36, and fluid inlet 38), fluid source 18, drive mechanism 22 (including drive plate 44, wobble plate shaft 46, wobble plate 48, ball joint 50, and bearings 52), clamshell section **30*a*, clamshell connector 32, outlet assembly 40, and drive shaft 42**.

Outer housing 12 is formed, in the illustrated embodiment, from two complementary clamshell sections 30, of which one clamshell section 30*a* is shown (see FIG. 3 for a depiction of both clamshell sections 30*a* and 30*b*). Clamshell sections 30 together enclose other components of spray system 10, and are secured together via clamshell connectors 32. Clamshell connectors 32 can, for example, be pins or bolts. Clamshell sections 30 provide a rigid structural enclosure that defines relative positions of internal components such as motor 14 and drive mechanism 22, and partially defines the position of pump housing 24 relative to piston 26.

As described above with respect to FIG. 1, pump assembly 16 includes pump housing 24 and piston 26. Pump housing 24 further includes pump chamber housing 34, which defines pumping chamber 36. Pump chamber housing 34 can, for example, be an overmolded carbide blank with fluid inlet 38 disposed to receive fluid from fluid source 18. Drive mechanism 22 drives piston 26 to reciprocate within pumping chamber 36, forcing fluid from fluid source 18 into outlet assembly 40. Outlet assembly 40 is a fluid passage extending to nozzle 20 (see FIG. 1). In some embodiments, outlet assembly 40 can include further valving disposed to prevent fluid leakage out nozzle 20.

Motor 14 rotates drive shaft 42, a rotating key that engages drive mechanism 22. Drive mechanism 22 converts rotation of drive shaft 42 into axial reciprocation of piston 26. In the depicted embodiment, drive mechanism 22 comprises drive plate 44, wobble plate shaft 46, wobble plate 48, ball joint 50, and bearings 52. Bearings 52 support wobble plate shaft 46. Drive plate 44 is a gear wheel or similar component that engages drive shaft 42 to rotate wobble plate shaft 46. Wobble plate shaft 46 carries wobble plate 48 via skewed threading, such that rotation of wobble plate shaft 46 imparts reciprocating motion on wobble plate 48. This reciprocating motion drives piston 26, which mates with wobble plate 48 at ball joint 50. Although most of the force imparted on piston 26 by wobble plate 48 of drive mechanism 22 is aligned with spray axis A, some portion of this force is transverse to spray axis A. This transverse force creates a side (lateral) load on piston 26. As described above with respect to FIG. 1, pump housing 24 is retained in position within outer housing 12 by alignment pins 28. Alignment pins 28 permit pump housing 24 a degree of lateral freedom sufficient to allow pump housing 24 to passively self-align with piston 26 as its orientation varies slightly due to side loads. This self-alignment improves part performance by reducing wear on pump chamber housing 34. In some embodiments, alignment pins 28 can, for example, permit at least 0.02 inch of lateral movement of pump housing 24 with respect to outer housing 12.

FIG. 3 is a lateral cross-sectional view of a portion of fluid sprayer 10. FIG. 3 illustrates outer housing 12 (with clamshell sections 30*a* and 30*b*, bores 54, and counterbores 58), pump assembly 16 (with pump housing 24, piston 26, alignment pins 28, and pump chamber housing 34), fluid source 18, and gaps 56. FIG. 3 illustrates a cross-section perpendicular to FIG. 2.

Outer housing 12 encloses other components of fluid sprayer 10, including pump assembly 16. Piston 26 reciprocates within pump chamber housing 34 of pump housing 24, drawing fluid out of fluid source 18 via fluid inlet 38. Outer housing 12 comprises mating clamshell sections 30*a* and 30*b*. Clamshell sections 30*a* and 30*b* each include bores 54 aligned with alignment pins 28 of pump housing 24. Each alignment pins 28 fits one corresponding bore 54. In the illustrated embodiment, bores 54 are retaining apertures with counterbores 58, and alignment pins 28 enter only counterbores 58 of bores 54. Like alignment pins 28, bores 54 are all parallel, and extend laterally (i.e. perpendicular to spray axis A). Counterbores 58 help prevent alignment pins 28 from locking or otherwise becoming stuck within bores 54 by discouraging suction and increasing the flexibility of clamshell sections 30 near bores 54. Alignment pins 28 are separated from outer housing 12 at bores 54 by gaps 56, which allow alignment pins 28 to slide laterally. Gaps 56 can, for example, have widths of 0.01 inch while pump housing 24 is in a center, resting position. This slideable reception of alignment pins 28 allows bores 54 to retain pump housing 24 axially while permitting pump housing 24 a limited degree of lateral freedom that facilitates passive self-alignment of pump housing 24 with piston 26, as discussed above with respect to FIG. 2.

The lateral freedom of pump housing 24 enabled by bores 54 and alignment pins 28 allows passive self-alignment that reduces the side load conferred by piston 26 on pump housing 24. This alleviation of side load increases part lifetimes without the need for rigid structures with tight manufacturing tolerances.

Discussion of Possible Embodiments

The following are non-exclusive descriptions of possible embodiments of the present invention.

A fluid sprayer comprises: a pump motor; a piston reciprocatable by the pump motor; a pump housing comprising: a pumping chamber housing disposed to receive the piston along a pump axis; and a plurality of alignment pins extending laterally away from the pumping chamber housing; and an outer housing surrounding and anchoring the pump motor, and having a plurality of internal lateral bores disposed to slideably receive the alignment pins, such that the pump housing is free to self-align with the piston.

The fluid sprayer of the preceding paragraph can optionally include, additionally and/or alternatively, any one or more of the following features, configurations and/or additional components:

A further embodiment of the foregoing fluid sprayer, further comprising a spray fluid source, and wherein the pump cylinder includes a fluid inlet from the spray fluid source.

A further embodiment of the foregoing fluid sprayer, further comprising a drive mechanism disposed between the pump motor and the piston to convert rotational motion of the pump motor into axial movement of the piston.

A further embodiment of the foregoing fluid sprayer, wherein the drive mechanism comprises a wobble plate.

A further embodiment of the foregoing fluid sprayer, wherein the wobble plate attaches to the piston via a ball joint.

A further embodiment of the foregoing fluid sprayer, further comprising a spray nozzle situated downstream of the pump cylinder.

A further embodiment of the foregoing fluid sprayer, wherein the outer housing comprises mating first and second clamshell housing sections.

A further embodiment of the foregoing fluid sprayer, wherein the plurality of alignment pins includes a first set of alignment pins slideably received in a first subset of the internal lateral bores in the first clamshell housing section, and a second set of alignment pins slideably received in a second subset of the internal lateral bores in the second clamshell housing section.

A further embodiment of the foregoing fluid sprayer, wherein the first and second subsets of internal lateral bore are mirror images.

A further embodiment of the foregoing fluid sprayer, wherein the first and second sets of alignment pins each comprise four alignment pins.

A further embodiment of the foregoing fluid sprayer, wherein the four alignment pins of each of the first and second sets of alignment pins are arranged in a rectangular pattern.

A further embodiment of the foregoing fluid sprayer, wherein all of the plurality of alignment pins are parallel.

A further embodiment of the foregoing fluid sprayer, wherein the pump housing is formed of acetal.

A further embodiment of the foregoing fluid sprayer, wherein the outer housing is formed of plastic.

A further embodiment of the foregoing fluid sprayer, wherein the pump housing is rated for pressures of up to 2000 psi.

A further embodiment of the foregoing fluid sprayer, wherein the pump housing is free to move laterally at least 0.02 inch relative to the outer housing.

A further embodiment of the foregoing fluid sprayer, wherein the internal lateral bores include counterbores, and wherein the plurality of alignment pins enter only the counterbores of each of the plurality of alignment pins.

A further embodiment of the foregoing fluid sprayer, wherein the lateral bores and the alignment pins define a gap therebetween.

A further embodiment of the foregoing fluid sprayer, wherein the self-aligning of the pump housing with the piston comprises passive centering of the pump housing on the piston.

Summation

Any relative terms or terms of degree used herein, such as "substantially", "essentially", "generally", "approximately" and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, alignment or shape variations induced by thermal, rotational or vibrational operational conditions, and the like.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A fluid sprayer comprising:

a pump motor;

a piston reciprocatable by the pump motor along a pump axis;

a pump housing comprising:

a pumping chamber housing disposed to receive the piston along the pump axis; and a plurality of alignment pins extending laterally away from the pumping chamber housing; and an outer housing surrounding and anchoring the pump motor, and having a plurality of internal lateral bores disposed to slideably receive the alignment pins, such that the pump housing is locked against axial movement along the pump axis and is free to self-align with the piston by movement within the outer housing along a dimension perpendicular to the pump axis.

2. The fluid sprayer of claim 1, further comprising a spray fluid source, and wherein the pump cylinder includes a fluid inlet from the spray fluid source.

3. The fluid sprayer of claim 1, further comprising a drive mechanism disposed between the pump motor and the piston to convert rotational motion of the pump motor into axial movement of the piston.

4. The fluid sprayer of claim 3, wherein the drive mechanism comprises a wobble plate.

5. The fluid sprayer of claim 4, wherein the wobble plate attaches to the piston via a ball joint.

6. The fluid sprayer of claim 1, further comprising a spray nozzle situated downstream of the pump cylinder.

7. The fluid sprayer of claim 1, wherein the outer housing comprises mating first and second clamshell housing sections.

8. The fluid sprayer of claim 7, wherein the plurality of alignment pins includes a first set of alignment pins slideably received in a first subset of the internal lateral bores in the first clamshell housing section, and a second set of alignment pins slideably received in a second subset of the internal lateral bores in the second clamshell housing section.

9. The fluid sprayer of claim 8, wherein the first and second subsets of internal lateral bore are mirror images.

10. The fluid sprayer of claim 9, wherein the first and second sets of alignment pins each comprise four alignment pins.

11. The fluid sprayer of claim 10, wherein the four alignment pins of each of the first and second sets of alignment pins are arranged in a rectangular pattern.

12. The fluid sprayer of claim 9, wherein all of the plurality of alignment pins are parallel.

13. The fluid sprayer of claim 1, wherein the pump housing is formed of acetal.

14. The fluid sprayer of claim 1, wherein the outer housing is formed of plastic.

15. The fluid sprayer of claim 1, wherein the pump housing is rated for pressures of up to 2000 psi.

16. The fluid sprayer of claim 1, wherein the pump housing is free to move laterally at least 0.02 inch relative to the outer housing.

17. The fluid sprayer of claim 1, wherein the internal lateral bores include counterbores, and wherein the plurality of alignment pins enter only the counterbores of each of the plurality of internal lateral bores.

18. The fluid sprayer of claim 1, wherein the lateral bores and the alignment pins define a gap therebetween.

19. The fluid sprayer of claim 1, wherein the self-aligning of the pump housing with the piston comprises passive centering of the pump housing on the piston.

* * * * *